US007461992B2

(12) United States Patent
Griffon

(10) Patent No.: US 7,461,992 B2
(45) Date of Patent: Dec. 9, 2008

(54) APPLICATOR AND A KIT INCLUDING SUCH AN APPLICATOR

(75) Inventor: Claire Griffon, Paris (FR)

(73) Assignee: L'Oreal, Paris (FR)

( * ) Notice: Subject to any disclaimer, the term of this patent is extended or adjusted under 35 U.S.C. 154(b) by 561 days.

(21) Appl. No.: 11/114,137

(22) Filed: Apr. 26, 2005

(65) Prior Publication Data

US 2006/0099026 A1 May 11, 2006

Related U.S. Application Data

(60) Provisional application No. 60/570,138, filed on May 12, 2004.

(30) Foreign Application Priority Data

Apr. 27, 2004 (FR) ..... 04 50804

(51) Int. Cl.

| | |
|---|---|
| ***B05C 11/00*** | (2006.01) |
| ***A47L 13/30*** | (2006.01) |
| ***A47K 7/02*** | (2006.01) |
| ***A45D 40/24*** | (2006.01) |

(52) U.S. Cl. ..... 401/266; 401/261; 401/200; 401/201; 132/307; 132/317

(58) Field of Classification Search ..... 401/266, 401/28, 261, 130, 126, 200, 201; 132/307, 132/317, 318, 320

See application file for complete search history.

(56) References Cited

U.S. PATENT DOCUMENTS

| | | | | |
|---|---|---|---|---|
| 4,378,653 | A * | 4/1983 | O'Brien | 446/46 |
| 4,430,013 | A | 2/1984 | Kaufman | |
| 4,726,700 | A * | 2/1988 | Gray | 401/183 |
| 4,917,134 | A * | 4/1990 | Simonzi | 132/320 |
| 5,019,033 | A * | 5/1991 | Geria | 604/2 |
| 2003/0123919 | A1* | 7/2003 | Gueret | 401/130 |

FOREIGN PATENT DOCUMENTS

| | | |
|---|---|---|
| DE | 40 37 821 A | 6/1992 |
| EP | 1 314 373 A | 5/2003 |
| FR | 1 041 075 A | 10/1953 |

* cited by examiner

*Primary Examiner*—David J Walczak
(74) *Attorney, Agent, or Firm*—Oliff & Berridge, PLC

(57) ABSTRACT

An applicator may include a first wall that is elastically deformable, at least in part, and arranged to take up a first stable configuration and a second stable configuration. The applicator may further include a second wall co-operating with the first wall to define an inside space and a plurality of bodies disposed in the inside space. At least some of the bodies may be pressed by the first wall against the second wall, at least when the first wall is in the second stable configuration.

46 Claims, 2 Drawing Sheets

APPLICATOR AND A KIT INCLUDING SUCH AN APPLICATOR

CROSS-REFERENCE TO RELATED APPLICATIONS

This non-provisional application claims the benefit of French Application No. 04 50804 filed on Apr. 27, 2004, and U.S. Provisional Application No. 60/570,138 filed on May 12, 2004.

BACKGROUND

The present invention relates to applicators for applying a cosmetic or care product.

European patent application EP A1 1 314 373 describes applicators including an inside space housing a plurality of bodies, such as beads, for example. The inside space containing the bodies is defined at least in part by a permeable wall that allows a liquid to flow into the inside space and be retained by capillarity between the bodies.

German patent application DE 4 037 821 describes a cushion comprising a case containing a plurality of bodies such as limestone pebbles.

SUMMARY

There exists a need for an applicator that provides new possibilities, for example, in terms of appearance, hygiene, and ergonomics.

There also exist a need for new handling techniques and new sensory perceptions associated with applying a substance.

The invention seeks to satisfy such needs in full or in part.

Exemplary embodiments of the invention provide an applicator comprising: a first wall that is elastically deformable, at least in part, arranged to take up a first stable configuration and a second stable configuration; a second wall co-operating with the first wall to define an inside space; and a plurality of bodies disposed in the inside space, at least some of the bodies being pressed by the first wall against the second wall, at least when the first wall is in the second stable configuration.

Exemplary embodiments of the invention provide an applicator comprising: a first wall that is elastically deformable, at least in part, arranged to take up a first stable configuration and a second stable configuration; a second wall co-operating with the first wall to define an inside space; and a substance disposed in the inside space, at least part of the second wall being permeable to the substance, the substance being pressed against the second wall by the first wall, at least when the first wall is in the second stable configuration.

Where appropriate or desired, the substance may impregnate a substrate contained in the inside space.

Exemplary embodiments of the invention provide an applicator comprising: a first wall that is elastically deformable, at least in part, arranged to take up a first stable configuration and a second stable configuration; a second wall that is permeable, at least in part, to a substance, and that co-operates with the first wall to define an inside space; and a substrate disposed in the inside space, said substrate arranged to absorb and release the substance, the substrate being pressed against the second wall by the first wall, at least when the first wall is in the second stable configuration.

In exemplary embodiments, the substrate may comprise a structure that is one of cellular and fibrous. For example, the substrate may comprise one of a foam and a sponge. The substrate may optionally be impregnated with one of a cosmetic and a care product. For example, the substrate may be packaged with such a substance. Alternatively or additionally, the substrate may receive the substance just before use.

In exemplary embodiments, the second wall may preferably be elastically deformable, at least in part.

In exemplary embodiments, the change in configuration of the first wall may impart a novel appearance to the applicator and make the applicator fun to play with. In exemplary embodiments, the deformability of the second wall may enable substance to some extent to be applied closely to the outline of the surface being treated. The bodies and/or the substance may also be protected to some extent from dirtying when the first wall is in the first stable configuration.

In exemplary embodiments, the bodies and/or the substance may be pressed more strongly by the first wall against the second wall when the first wall is in the second stable configuration than when the first wall is in the first stable configuration.

For example, when the first wall is in the first stable configuration, the applicator may provide a greater freedom of movement for the bodies in the inside space and facilitate cleaning the bodies, if the bodies are designed to be cleaned.

Where appropriate or desired, when the inside space contains a substance that is capable of passing through the second wall, the configuration of the applicator may make it possible to force the substance through the second wall only while the first wall is in the second stable configuration.

In exemplary embodiments, the first wall, in the first stable configuration, may have a shape that is generally outwardly convex. The first wall may be changed from one stable configuration to the other stable configuration, for example, by inverting a side on which the first wall is concave.

In exemplary embodiments, the second wall may be secured to the first wall at a periphery thereof. For example, the second wall may be fastened to the first wall optionally in a removable manner. The second wall may be heat-sealed to the first wall, for example. The first wall may include an annular border on which the second wall is fastened, for example.

In exemplary embodiments, the second wall may comprise at least one of a net, a foam, a woven or non-woven fabric, and a perforated film, possibly coated in flocking. The second wall may preferably be elastically deformable, but may also be deformable in non-elastic manner. Where appropriate or desired, the second wall may be made as a single piece together with at least a portion of the first wall.

In exemplary embodiments, the plurality of bodies may comprise beads. At least some of the bodies may be made of a material that is inert relative to a substance for application. At least some of the bodies may include at least one agent that is one of cosmetically active and dermatologically active. At least some of the bodies may include at least one magnetic property. At least one of the bodies may be sintered, for example, comprising a sintered ceramic. The bodies may have a maximum dimension that is less than or equal to 5 millimeters (mm). For example, the maximum dimension may be less than or equal to 3 mm. The plurality of bodies may comprise more than about 100 bodies. At least two of the bodies may be different. For example, at least two of the bodies may include different active agents.

In exemplary embodiments, the second wall may be configured in such a manner as to allow at least one of the bodies to come into contact with a surface being treated, but without allowing the body to pass right through the second wall.

In exemplary embodiments, the inside space may have a volume that is occupied to at least 50% by the bodies contained in the inside space when the first wall is in the first stable configuration. For example, the bodies may occupy substantially all of the volume of the inside space when the first wall is in the first stable configuration.

In exemplary embodiments, the applicator may include a handle member that extends the first wall.

In exemplary embodiments, the applicator may include a cap for closing the inside space. The cap may house a supply of substance, where appropriate or desired.

The cap may have a variety of shapes. For example, the cap may be substantially hemispherical in shape. When in place, the cap may co-operate with the first wall so as to constitute a shape that is substantially spherical, for example, when the first wall is substantially hemispherical when in the first stable configuration.

Exemplary embodiments of the invention provide a kit comprising an applicator and a substance for applying with said applicator to at least one of skin, mucous membranes, nails, and hair. For example, the substance may be makeup and/or a care product for skin, such as a color, a shine-control agent or a concealing agent. The substance may be packaged independently of the applicator. Alternatively, the substance may be packaged in a cap for closing the inside space. Further, the substance may be packaged in the inside space itself, providing the second wall is at least in part permeable to the substance or to a solvent for the substance.

Exemplary embodiments of the invention provide a method of applying a substance to skin, the method comprising: bringing a surface to be treated into contact with the second wall of an applicator as defined above with the second wall is in the second stable configuration.

In exemplary embodiments, prior to application, the first wall may be changed by a user from the first stable configuration to the second stable configuration. After application, the first wall may be returned by the user to the first stable configuration, for example, to facilitate cleaning the bodies possibly contained in the inside space, to allow a closure cap to be put into place on the applicator, or to protect the bodies and/or the substance from being dirtied.

BRIEF DESCRIPTION OF THE DRAWINGS

The invention may be better understood on reading the following detailed description of non-limiting embodiments thereof, and on examining the accompanying drawing, in which.

DETAILED DESCRIPTION OF EMBODIMENTS

Figure 1:
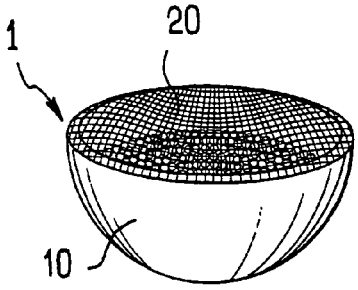
FIG. 1 is a diagrammatic perspective view of an exemplary embodiment of an applicator with the first wall being in the first stable configuration.
Figure 2:
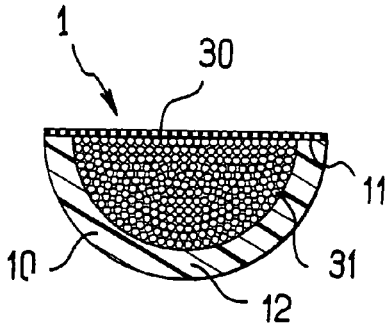
FIG. 2 is a diagrammatic cross-sectional view taken along a midplane of the applicator of FIG. 1.
Figure 3:
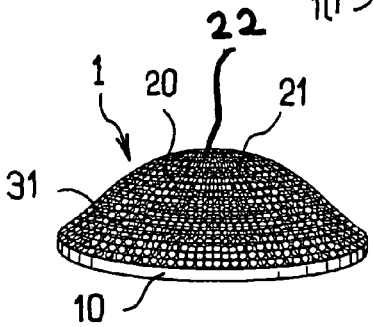
FIG. 3 shows the applicator of FIG. 1 when the first wall is in the second stable configuration.

As shown in FIGS. 1 to 4, an exemplary applicator 1 may comprise a first wall 10 that is arranged to take up a first configuration as shown in FIG. 1 and a second configuration as shown in FIG. 3. In this exemplary embodiment, the first wall 10 may have a shape that is substantially hemispherical while in the first configuration, as shown in FIG. 2.

The applicator 1 may also have a second wall 20 that is permeable and that co-operates with the first wall 10 to define an inside space 30 containing a plurality of bodies 31.

In this exemplary embodiment, the second wall 20 may be elastically deformable. For example, the second wall 20 may be constituted by a net of mesh size that is sufficiently small to prevent the bodies 31 from passing therethrough. The bodies 31 may be constituted by small beads, for example, as shown.

For example, the second wall 20 may be fastened at a periphery 21 thereof to an end edge 11 of the first wall 10, as shown in FIG. 2. This fastening may be performed using adhesive or heat-sealing, for example, depending on the nature of the materials, or by other means, for example, by using an additional fastener part, such as by clamping the second wall 20 against the first wall 10. Where appropriate or desired, the second wall 20 may be fastened to the first wall 10 in a separable manner, for example, to allow the bodies 31 to be replaced, to allow a substance to be inserted into the inside space 30, or to insert bodies 31 that are selected as a function of some particular use.

In this exemplary embodiment, the first wall 10 maybe made of an elastically deformable material, thus enabling the user to cause the first wall 10 to take up the second configuration as shown in FIG. 3, in which the side of the first wall 10 that is concave is inverted relative to the configuration shown in FIG. 1.

For example, the first wall 10 may be changed from the first configuration to the second configuration by pressing with two thumbs against a central region 12 of the first wall 10, while retaining the edge 11 thereof with the index and middle fingers of each hand. On changing from the first configuration to the second configuration, the first wall 10 may pass through a state in which internal stresses are at a maximum. In the second configuration, the first wall 10 may hold the body 31 pressed against the second wall 20, as shown in FIG. 3, and the second wall 20 may have a shape that is generally outwardly convex, for example, substantially hemispherical. A quantity of the bodies 31 contained in the inside space 30, and/or a size, and/or an elasticity of the second wall 20 may be selected, for example, to enable such a result to be obtained.

Figure 5:
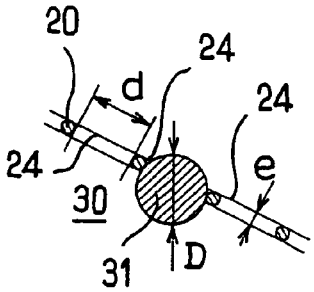
FIG. 5 illustrates how the bodies may come into contact with the surface being treated.

Advantageously, the second wall 20 may include openings 24 of thickness e and of smallest dimension d selected in such a manner as to allow the bodies 31 to project from the second wall 20, as shown in FIG. 5. The smallest dimension d may nevertheless be smaller than a diameter D of the bodies 31 so as to prevent the bodies 31 from passing through the second wall 20.

Figure 4:
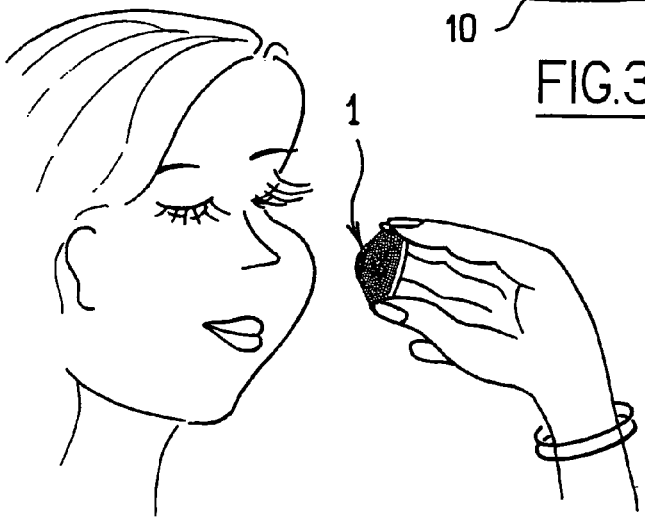
FIG. 4 illustrates the applicator of FIGS. 1 to 3 in use.

The user may take hold of the applicator 1 via its periphery, as shown in FIG. 4, and make use of a central region 22 of the second wall 20 to massage and/or apply a substance and/or treat skin, for example, to perform dermabrasion thereon.

During application, the bodies 31 may move relative to one another, thus enabling the applicator 1 to adapt to some extent to an outline of the surface being treated.

Where appropriate or desired, prior to bringing the applicator into contact with the surface to be treated, the user may fill the applicator with a substance, for example, by rubbing the central region 22 on a cake of substance or by putting the applicator down on the substance.

After use, the user may return the first wall 10 to its initial configuration by pressing the thumb against the central region 22 while pressing other fingers against an opposite face of the first wall 10.

Figure 6:
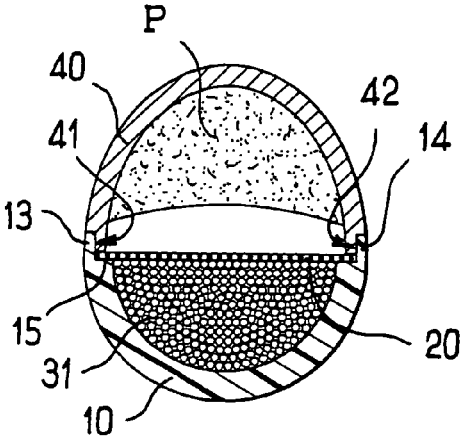
FIGS. 6 and 7 show two additional exemplary embodiments of an applicator.

Depending on the elasticity of the second wall 20 and on the extent to which the inside space 30 is filled with the bodies 31, the bodies 31 may possess freedom of movement to a greater or lesser extent while in the first configuration. Greater freedom of movement may facilitate cleaning of the bodies 31, for example, by putting the applicator 1 in running water.

Where appropriate or desired, and as shown in FIG. 6 for example, the first wall 10 may be configured so as to allow a closure cap 40 to be put into place while the applicator 1 is not in use. For example, the first wall 10 may include a portion in relief 13 at a periphery thereof, for example, an annular lip, and the cap 40 may be configured to attach to the relief 13. For example, the cap 40 may include an annular lip 41 arranged to snap-fasten with the portion in relief 13 of the first wall 10. For example, the portion in relief 13 may include an annular bead 14 arranged to snap into a corresponding groove 42 in the cap 40.

In the exemplary embodiment shown in FIG. 6, the second wall 20 may be fastened to the first wall 10 along a margin 15 situated radially inside the portion in relief 13.

The cap 40 may serve solely to close the applicator. Alternatively, the cap 40 may include a supply of substance P, for example, a dispersible substance that has been cast or compacted in the inside of the cap 40.

Figure 7:
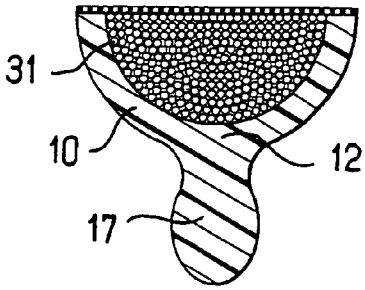

The invention is not limited to the particular shapes shown for the first wall 10. For example, the applicator 1 may include a handle portion 17, as shown in FIG. 7, with the handle portion 17 possibly extending outward from the central region 12.

The first wall 10 may preferably be made entirely out of a material that is elastically deformable. But, it would not go beyond the ambit of the present invention for the first wall 10 to be made only in part out of an elastically deformable material, with, for example, the handle portion 10 being made of a material that is not elastically deformable. The material from which the first wall 10 is made need not necessarily be an elastomer.

Where appropriate or desired, the first wall 10 may include an opening enabling bodies 31 to be inserted therein and/or enabling the bodies 31 therein to be replaced by other bodies 31, or enabling a substance to be inserted. Further, the opening may be provided with closure means.

The second wall 20 need not be entirely permeable. For example, the second wall 20 may include openings solely in the central portion 22 thereof.

Figure 8:
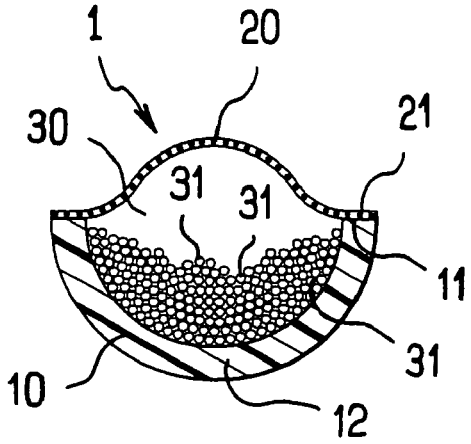
FIG. 8 is a view analogous to FIG. 2 showing another exemplary of an applicator.

The second wall 20 may be made other than as a net. For example, the second wall 20 may comprise a foam, such as a foam having open cells, a woven or non-woven fabric, or a perforated film, and, where appropriate or desired, may be coated in flocking. The second wall 20 may be of composite structure, for example, including two layers of different kinds, such as a foam and a net, or a foam and a perforated film, or a foam and a non-woven fabric, with still other combinations being possible. Where appropriate or desired, the second wall 20 need not be elastically deformable, as shown in FIG. 8.

Under such circumstances, the bodies 31 need not occupy an entire volume of the inside space 30 while the first wall is in the first configuration.

The bodies 31 may be made in various ways, and the inside space 30 may contain one or more types of bodies 31.

For example, the bodies 31 may be completely inert relative to the substance to be applied. Alternatively, the bodies 31 may be configured in such a manner as to release at least one agent that is cosmetically active or dermatologically active, for example, on coming into contact with a liquid such as water or a lotion. Such a liquid may pass through the second wall 20, for example.

Where appropriate or desired, the bodies 31 may have at least one magnetic property to exert an action on microcirculation of the blood, for example.

The bodies 31 may also be arranged to dissolve, disperse, or break up progressively on coming into contact with a liquid, such as water, a water-and-alcohol lotion, or an oil, or under the effect of friction exerted by the applicator 1 on the surface being treated.

The substance for application to the surface being treated may come solely from the bodies 31. In such embodiments, the bodies may optionally be constituted by or include small quantities of the substance.

Figure 9:
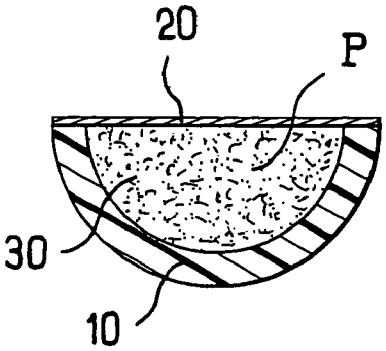
FIGS. 9 and 10 are cross-sectional views taken along in a midplane of an applicator containing a substance for application, with the first wall in the first and second stable configurations, respectively.
Figure 10:
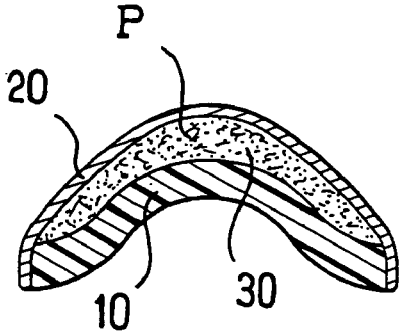

In the exemplary embodiment shown in FIG. 9, the inside space 30 may contain the substance P, for example, a gel or a paste, and the second wall 20 may be permeable to the substance P, at least when the first wall is in the second configuration, as shown in FIG. 10.

The applicator 1 may be made in such a manner that when the first wall 10 is in the first configuration, the substance P is retained in the inside space. A porosity of the second wall may be sufficiently small to prevent the substance P from passing therethrough in the absence of pressure being exerted on the substance P. When the first wall 10 is in the second configuration, as shown in FIG. 10, the volume of the inside space may have been decreased and the substance may thus be pushed by the first wall 10 against the second wall 20. In addition, the second wall 20 may take up a generally convex shape that makes application easier. Substance may pass through the second wall 20 during application, for example, because of the pressure exerted on the substance P by the first wall 10 and/or the pressure and/or the friction exerted against the surface being treated during application.

Figure 11:
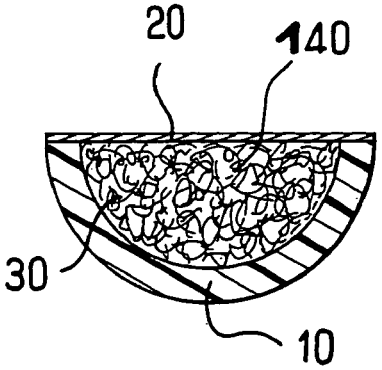
FIG. 11 is a view analogous to FIG. 2 showing another exemplary embodiment of an applicator.

FIG. 11 shows a possibility of the inside space 30 receiving a substrate 140 that is optionally elastically compressible, such as an open-celled foam, for example.

The substrate 140 may be selected to have compressibility in such a manner as to ensure that the substrate 140 does not prevent the first wall 10 from changing configuration.

The substrate 140 may be impregnated in a liquid substance or a solid substance prior to first use. For example, the substrate may be made available to a user in this state. The substrate 140 may be arranged in such a manner as to be compressed by the first wall 10 when in the second configuration. Where appropriate or desired, the substrate 140 may also be provided to the user while not preimpregnated, leaving the user free to decide which substance is to be applied and to impregnate the substrate 140 therewith.

The invention is not limited to the exemplary embodiments shown. For example, various characteristics of the exemplary embodiments may be combined with one another.

Throughout the description, including in the claims, the term "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. An applicator comprising:

a first wall that is elastically deformable, at least in part, and arranged to take up a first stable configuration and a second stable configuration;

a second wall co-operating with the first wall to define an inside space; and a plurality of bodies disposed in the inside space, at least some of the bodies being pressed by the first wall against the second wall, at least when the first wall is in the second stable configuration, wherein the first wall, when in the first configuration, presents a shape that is generally outwardly convex.

2. An applicator according to claim 1, wherein the bodies are pressed by the first wall against the second wall more strongly when the first wall is in the second stable configuration than when the first wall is in the first stable configuration.

3. An applicator according to claim 1, wherein at least part of the second wall is elastically deformable.

4. An applicator according to claim 1, wherein at least part of the second wall is permeable.

5. An applicator according to claim 1, wherein the second wall is secured at a periphery thereof to the first wall.

6. An applicator according to claim 5, wherein the first wall has an annular margin to which the second wall is fastened.

7. An applicator according to claim 1, wherein the first wall passes from one stable configuration to the other stable configuration by inverting a concave side.

8. An applicator according to claim 1, wherein the second wall comprises a net.

9. An applicator according to claim 1, wherein the plurality of bodies comprises a plurality of beads.

10. An applicator according to claim 1, wherein at least some of the bodies are made of a material that is inert relative to a substance for application.

11. An applicator according to claim 1, wherein at least some of the bodies comprise at least one of a cosmetically active agent and a dermatologically active agent.

12. An applicator according to claim 1, wherein at least some of the bodies include a magnetic property.

13. An applicator according to claim 1, wherein at least one of the bodies comprises a sintered material.

14. An applicator according to claim 1, wherein at least two of the bodies are different.

15. An applicator according to claim 1, wherein at least two of the bodies comprises different active agents.

16. An applicator according to claim 1, wherein the inside space defines a volume that is occupied to at least 50% by the bodies when the first wall is in the first stable configuration.

17. An applicator according to claim 1, wherein the bodies include a maximum dimension less than or equal to 5 mm.

18. An applicator according to claim 1, wherein the bodies include a maximum dimension less than or equal to 3 mm.

19. An applicator according to claim 1, wherein the plurality of bodies comprises more than about 100 bodies.

20. An applicator according to claim 1, further comprising a handle member that extends from the first wall.

21. An applicator according to claim 1, further comprising a cap for closing the inside space.

22. An applicator according to claim 21, wherein the cap houses a supply of substance.

23. An applicator according to claim 22, wherein the cap, when in place, co-operates with the first wall to form a shape that is substantially spherical.

24. An applicator according to claim 21, wherein the cap has a shape that is substantially hemispherical.

25. An applicator according to claim 1, wherein the second wall is not elastically deformable.

26. An applicator according to claim 1, wherein the second wall is configured in such a manner as to allow at least one of the bodies to come into contact with a surface being treated, but without allowing the body to pass fully through the second wall.

27. A kit comprising an applicator as defined in claim 1, together with a substance for applying with the applicator to at least one of skin, mucous membranes, nails and hair.

28. A method of applying a substance to skin, the method comprising:

bringing a surface to be treated into contact with the second wall of an applicator as defined in claim 1 with the first wall in the second stable configuration.

29. A method according to claim 28, wherein, prior to application, the first wall is changed by a user from the first stable configuration to the second stable configuration.

30. A method according to claim 28, wherein, after application, the first wall is returned by the user to the first stable configuration.

31. An applicator comprising:

a first wall that is elastically deformable, at least in part, and arranged to take up a first stable configuration and a second stable configuration;

a second wall co-operating with the first wall to define an inside space; and a substance disposed in the inside space, at least part of the second wall being permeable to the substance, the substance being pressed against the second wall by the first wall, at least when the first wall is in the second stable configuration, wherein the first wall, when in the first configuration, presents a shape that is generally outwardly convex.

32. An applicator according to claim 31, wherein the substance is pressed by the first wall against the second wall more strongly when the first wall is in the second stable configuration than when the first wall is in the first stable configuration.

33. An applicator according to claim 31, wherein at least part of the second wall is elastically deformable.

34. An applicator according to claim 31, wherein the first wall passes from one stable configuration to the other stable configuration by inverting a concave side.

35. An applicator according to claim 31, wherein the substance impregnates a substrate disposed in the inside space.

36. An applicator comprising:

a first wall that is elastically deformable, at least in part, and arranged to take up a first stable configuration and a second stable configuration;

a second wall that is permeable, at least in part, to a substance, and that co-operates with the first wall to define an inside space; and a substrate disposed in the inside space, the substrate arranged to absorb and release the substance, the substrate being pressed against the second wall by the first wall, at least when the first wall is in the second stable configuration, wherein the first wall, when in the first configuration, presents a shape that is generally outwardly convex.

37. An applicator according to claim 36, wherein the substrate is pressed by the first wall against the second wall more strongly when the first wall is in the second stable configuration than when the first wall is in the first stable configuration.

38. An applicator according to claim 36, wherein at least part of the second wall is elastically deformable.

39. An applicator according to claim 36, wherein the substrate comprises a cellular structure.

40. An applicator according to claim 39, wherein the substrate comprises at least one of a foam and a sponge.

41. An applicator according to claim 36, wherein the substrate comprises a fibrous structure.

42. An applicator according to claim 36, wherein the substrate is impregnated with at least one of a cosmetic and a care product.

43. An applicator comprising:

a first wall that is elastically deformable, at least in part, and arranged to take up a first stable configuration and a second stable configuration;

a second wall that is permeable, at least in part, to a substance, and that co-operates with the first wall to define an inside space; and a substrate disposed in the inside space, the substrate arranged to absorb and release the substance, the substrate being pressed against the second wall by the first wall, at least when the first wall is in the second stable configuration, wherein the first wall passes from one stable configuration to the other stable configuration by inverting a concave side.

44. An applicator comprising:

a first wall that is elastically deformable, at least in part, and arranged to take up a first stable configuration and a second stable configuration;

a second wall co-operating with the first wall to define an inside space; and a plurality of bodies disposed in the inside space, at least some of the bodies being pressed by the first wall against the second wall, at least when the first wall is in the second stable configuration, wherein the second wall is heat-sealed to the first wall.

45. An applicator comprising:

a first wall that is elastically deformable, at least in part, and arranged to take up a first stable configuration and a second stable configuration;

a second wall co-operating with the first wall to define an inside space; and a substance disposed in the inside space, at least part of the second wall being permeable to the substance, the substance being pressed against the second wall by the first wall, at least when the first wall is in the second stable configuration, wherein the second wall is heat-sealed to the first wall.

46. An applicator comprising:

a first wall that is elastically deformable, at least in part, and arranged to take up a first stable configuration and a second stable configuration;

a second wall that is permeable, at least in part, to a substance, and that co-operates with the first wall to define an inside space; and a substrate disposed in the inside space, the substrate arranged to absorb and release the substance, the substrate being pressed against the second wall by the first wall, at least when the first wall is in the second stable configuration, wherein the second wall is heat-sealed to the first wall.

* * * * *